US007794073B2

(12) United States Patent
Shoki

(10) Patent No.: US 7,794,073 B2
(45) Date of Patent: Sep. 14, 2010

(54) INK JET PRINTER

(75) Inventor: Mikio Shoki, Daito (JP)

(73) Assignees: Funai Electric Co., Ltd., Daito-shi (JP); Lexmark International, Inc., Lexington, KY (US)

( * ) Notice: Subject to any disclaimer, the term of this patent is extended or adjusted under 35 U.S.C. 154(b) by 1019 days.

(21) Appl. No.: 11/502,451

(22) Filed: Aug. 11, 2006

(65) Prior Publication Data

US 2007/0040884 A1 Feb. 22, 2007

(30) Foreign Application Priority Data

Aug. 18, 2005 (JP) ..... 2005-237246

(51) Int. Cl.
*B41J 29/38* (2006.01)
*B41J 2/01* (2006.01)
*B41J 29/393* (2006.01)

(52) U.S. Cl. ..... 347/101; 347/9; 347/14; 347/16; 347/19; 347/104

(58) Field of Classification Search ..... 347/5, 347/8, 9, 12, 14, 16, 19, 101, 104
See application file for complete search history.

(56) References Cited

U.S. PATENT DOCUMENTS 4,102,565 A * 7/1978 Takizawa et al. ..... 351/214
4,488,808 A * 12/1984 Kato ..... 356/73
4,687,322 A * 8/1987 Tanimoto et al. ..... 355/55
5,018,851 A * 5/1991 Matsumura ..... 351/214
5,699,153 A * 12/1997 Takamoto et al. ..... 356/237.1
5,883,646 A * 3/1999 Beauchamp ..... 347/19
5,905,512 A * 5/1999 Beauchamp ..... 347/19
6,036,298 A * 3/2000 Walker ..... 347/19
6,084,607 A * 7/2000 Matsuda ..... 347/19
6,312,082 B1 * 11/2001 Lund et al. ..... 347/19
6,352,331 B1 * 3/2002 Armijo et al. ..... 347/19
6,457,801 B1 * 10/2002 Fish et al. ..... 347/19
6,582,049 B2 * 6/2003 Cook ..... 347/19

(Continued)

FOREIGN PATENT DOCUMENTS

JP 58095329 A * 6/1983

(Continued)

*Primary Examiner*—Stephen D Meier
*Assistant Examiner*—Leonard S Liang
(74) *Attorney, Agent, or Firm*—Crowell & Moring LLP

(57) ABSTRACT

A light guide 3*c* of the printing shear detection sensor 3 is shaped so that the width of a side cross section when viewed in the conveying direction of a recording paper sheet P indicated by arrow B may be gradually smaller with an increasing degree of change from the top toward the bottom. The light emitted from the light emitting device 3*a* is incident on the light guide 3*c* from above, passes through the light guide 3*c* while being reflected on the side surface of the light guide 3*c*, is emitted toward the recording paper sheet P from the bottom of the light guide 3*c*, converged and projected on the recording paper sheet P as slit-like light. The light reflected on the recording paper sheet P is incident on the light receiving device 3*b* and thus, the printing shear detection pattern formed on the recording paper sheet P can be detected with high accuracy. The light guide 3*c* can be manufactured with using an inexpensive molding die at low costs, distinct from the conventional condenser lens.

5 Claims, 3 Drawing Sheets

U.S. PATENT DOCUMENTS

| | | | | |
|---|---|---|---|---|
| 6,929,344 | B2 * | 8/2005 | Hwang | 347/19 |
| 7,407,245 | B2 * | 8/2008 | Endo | 347/14 |
| 2001/0026297 | A1 * | 10/2001 | Fujibayashi et al. | 347/19 |
| 2003/0001917 | A1 * | 1/2003 | King et al. | 347/19 |
| 2003/0112283 | A1 * | 6/2003 | Ward et al. | 347/5 |
| 2004/0228144 | A1 * | 11/2004 | Squicciarini | 362/555 |
| 2005/0078138 | A1 * | 4/2005 | Koyama | 347/19 |
| 2005/0275939 | A1 * | 12/2005 | Sander | 359/385 |

FOREIGN PATENT DOCUMENTS

| | | | | |
|---|---|---|---|---|
| JP | 60046892 | A | * | 3/1985 |
| JP | 63004769 | A | * | 1/1988 |
| JP | 08323489 | A | * | 12/1996 |
| JP | 2003-65741 | A | | 3/2003 |
| JP | 2007147316 | A | * | 6/2007 |

* cited by examiner

INK JET PRINTER

BACKGROUND OF THE INVENTION

1. Field of the Invention

The present invention relates to an ink jet printer having a function of correcting printing shear based on a printing shear detection pattern which is read by a printing shear detection sensor.

2. Description of the Related Art

Conventionally, an ink jet printer has been used to form an image on a recording paper sheet by discharging ink drops from a recording head of an ink cartridge while reciprocating a cartridge holding member (hereinafter referred to as a carrier) which mounts the ink cartridge thereon in a direction (hereinafter referred to as a main-scanning direction) perpendicular to a direction of conveying the recording paper sheet (hereinafter referred to as a sub-scanning direction). Such ink jet printer having a function of automatically correcting printing shear has been put to a practical use. For example, the function of automatically correcting printing shear is carried out so that a predetermined printing shear detection pattern is formed on a recording paper sheet by the recording head, and the pattern is read by the printing shear detection sensor when attaching the ink cartridge to the carrier, and a timing of controlling the recording head is adjusted on the basis of the read result.

FIG. 6 shows an example of a conventional printing shear detection sensor used for correcting printing shear. The printing shear detection sensor 83 is attached to the carrier. When reciprocating with the carrier in the main-scanning direction, the printing shear detection sensor 83 reads the printing shear detection pattern formed on the recording paper sheet P. The printing shear detection sensor 83 comprises a light emitting device 83*a* such as LED, a light receiving device 83*b* such as a photo transistor and two lenses 83*c* and 83*d* produced by molding resin or the like.

As shown in the figure, the light emitting device 83*a* is disposed so that light emitted from the light emitting device 83*a* may be radiated toward the recording paper sheet P located below the printing shear detection sensor 83 in a direction inclined with respect to the direction vertical to the recording paper sheet P. The light receiving device 83*b* is oriented to receive the light emitted from the light emitting device 83*a* which is further reflected on the recording paper sheet P.

The two lenses 83*c* and 83*d* are condenser lenses and provided on an optical path from the light emitting device 83*a* to the recording paper sheet P and an optical path from the recording paper sheet P to the light receiving device 83*b*, of the light radiated from the light emitting device 83*a*, respectively. The lens 83*c* is shaped and disposed so as to refract the light radiated from the light emitting device 83*a* to converge the light on a predetermined point on the recording paper sheet P as spot light. The lens 83*d* is shaped and disposed so as to refract the light reflected on the recording paper sheet P and to converge the light from the light receiving device 83*b* on a detectable area.

The printing shear detection sensor 83 carries out an operation detecting the printing shear detection pattern so that an intensity of the light, which is radiated from the light emitting device 83*a* and then reflected on the recording paper sheet P, is detected with the light receiving device 83*b*. That is, the printing shear detection sensor 83 detects the printing shear detection pattern based on the phenomenon that the intensity of the light incident on the light receiving device 83*b* varies corresponding to presence or absence of the printing shear detection pattern on the light reflection area on the recording paper sheet P.

Hereupon, for example, when directivity of the light radiated from the light emitting device 83*a* is weak and thus the light expands as it comes closer to the recording paper sheet P or the light reflected on the recording paper sheet P expands as it moves away from the recording paper sheet P, variations in the intensity of the light from the light emitting device 83*a* incident on the light receiving device 83*b* may become small, so that it causes the reduction of the detection accuracy of the printing shear detection pattern. In order to prevent this disadvantage, the lenses 83*c* and 83*d* are provided at the printing shear detection sensor 83 as described above for converging the light radiated from the light emitting device 83*a* on the recording paper sheet P and for converging the light reflected on the recording paper sheet P on the light receiving device 83*b*, thereby enabling the detection of the printing shear detection pattern, surely.

However, as described above, since the lenses 83*c* and 83*d* used in the printing shear detection sensor 83 are condenser lenses for surely converging light on one point on the recording paper sheet P or the light receiving device 83*b*, a molding die for forming the lenses 83*c* and 83*d* is expensive because it is particularly and precisely worked and shaped in optical precision, and thereby, the cost of the lenses 83*c* and 83*d* is increased. Consequently, the printer also becomes expensive.

On the other hand, Japanese Laid-Open Patent Publication No. 2003-65741 discloses a surface information detecting apparatus for judging whether the recording paper sheet P is embossed paper or high-quality paper by detection surface character of the medium to be detected on the basis of reflected light from the recording paper sheet P. This apparatus has a plurality of lenses for converging light incident on the light receiving device 83*b*. Thus, this apparatus has a problem similar to that in the above-mentioned case.

SUMMARY OF THE INVENTION

The present invention is conceived to solve the above-mentioned problem, and an object of the present invention is to provide an ink jet printer which can converge light emitted from a light emitting device on a recording paper sheet without using an expensive lens or the like, can detect a printing shear detection pattern by a printing shear detection sensor with high accuracy and can be manufactured at low costs.

To achieve the above-mentioned object, an ink jet printer in accordance with an aspect of the present invention comprises: an ink cartridge including an ink tank for storing ink therein and a recording head for discharging the ink stored in the ink tank to form an image on a recording paper sheet; a cartridge holding member for holding the ink cartridge; a driving means for reciprocating the cartridge holding member in a direction substantially perpendicular to a conveying direction of the recording paper sheet; a printing shear detection sensor including a light emitting device which emits light toward the recording paper sheet and a light receiving device which receives the light emitted from the light emitting device and reflected on the recording paper sheet, for reading a predetermined printing shear detection pattern formed on the recording paper sheet by the recording head; and a printing shear correction control means for correcting printing shear by adjusting discharge timing of the recording head based on the printing shear detection pattern read by the printing shear detection sensor.

The printing shear detection sensor further has a light guide disposed on an optical path of the light emitted from the light emitting device and has a cross section with substantially uniform width in the conveying direction of the recording paper sheet, and has a cross section so as to condense the light emitted from the light emitting device on the recording paper sheet in the direction substantially perpendicular to the conveying direction of the recording paper sheet, and thereby the light emitted from the light emitting device is incident on the light guide from above, emitted toward the recording paper sheet from the bottom of the light guide and projected on the recording paper sheet substantially in a shape of a slit.

With such configuration, the printing shear detection sensor has the light guide which has a substantially uniform width in the conveying direction of the recording paper sheet and has light condensing performance in the direction substantially perpendicular to the conveying direction of the recording paper sheet, so that the light emitted from the light emitting device is projected on the recording paper sheet substantially in the shape of a slit via the light guide. Since manufacturing cost of the light guide is lower than that of the expensive condenser lens which is formed to condense the light at a point on the recording paper sheet, it is possible to improve detection accuracy of the printing shear detection pattern and reduce manufacturing costs of the ink jet printer.

DETAILED DESCRIPTION OF THE EMBODIMENT

Figure 1:
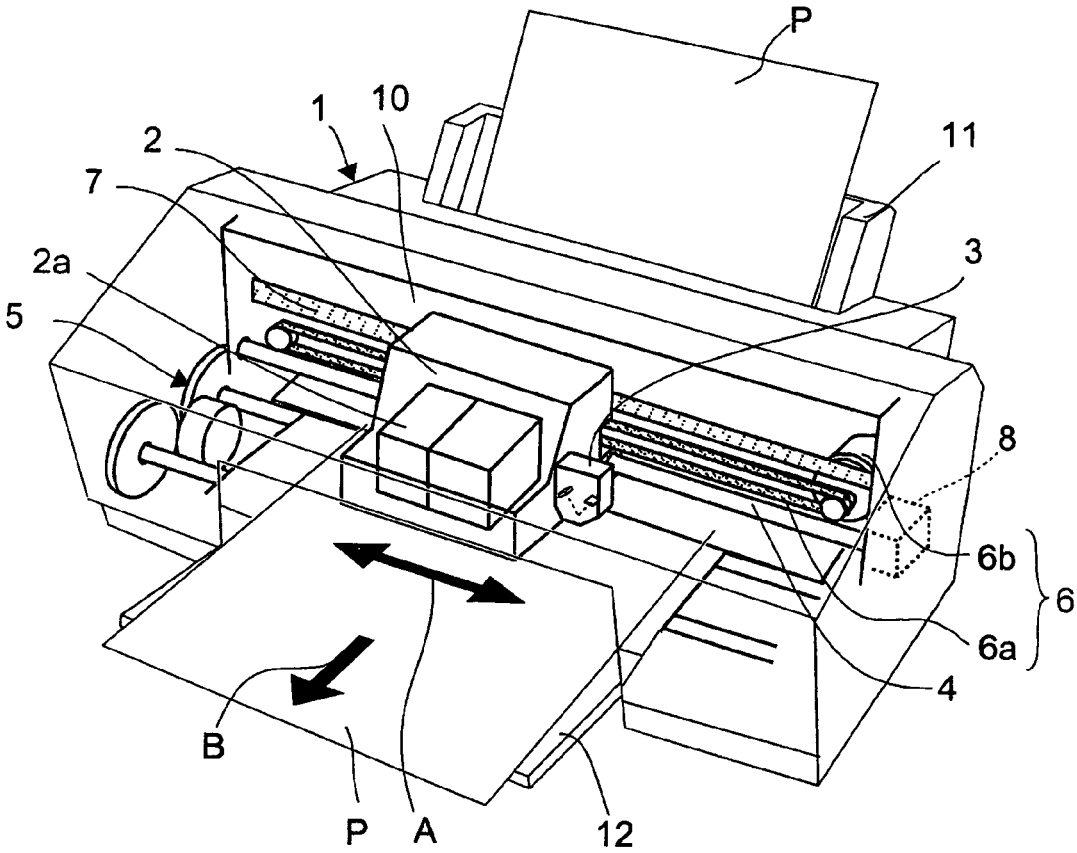
FIG. 1 is a perspective view showing an ink jet printer in accordance with an embodiment of the present invention.

An embodiment of the present invention will be described with reference to figures. FIG. 1 shows an example of an ink jet printer in accordance with the embodiment. The ink jet printer 1 forms an image on a recording paper sheet P conveyed in a predetermined conveying direction indicated by an arrow B with discharging ink drops toward the recording paper sheet P from recording heads (not shown) while reciprocating a carrier 2 (cartridge holding member) on which ink cartridges 2*a* each having the recording heads are mounted in a direction indicated by an arrow A which is perpendicular to the conveying direction of the recording paper sheet P. Hereinafter, the conveying direction of the recording paper sheet P is called "sub-scanning direction", and the direction of the reciprocation of the carrier 2 is called "main-scanning direction".

The ink jet printer 1 has a paper feeding tray 11 on which the recording paper sheets P to be printed are disposed, and a paper exit tray 12 to which printed recording paper sheets P are ejected. The paper feeding tray 11 is, for example, located at an upper rear portion of a housing 10 and the paper exit tray 12 is located at a lower front portion of the housing 10.

In the housing 10 of the ink jet printer 1, the carrier 2 is slidably held on a shaft 4 which is disposed so that the main-scanning direction should be a longitudinal direction of the housing 10, and is reciprocated along the shaft 4 by a driving force generated by a driving mechanism 6. The carrier 2 is slidably held on the shaft 4 at a rear face side thereof, and a printing shear detection sensor 3 is attached on a side face of the carrier 2. An encoder scale 7, which is used for detecting the position of the carrier 2 in the main-scanning direction, is provided in the vicinity of and parallel to the shaft 4. A recording paper conveying mechanism 5 for conveying the recording paper sheet P in the sub-scanning direction, and a control circuit 8 for controlling various operations of the ink jet printer 1 are further provided in the housing 10.

The control circuit 8 has a function of forming an image on the recording paper sheet P on the basis of data transmitted from a personal computer (not shown) or the like. The control circuit 8 may have a function of decompressing, for example, JPEG compressed image data transmitted from a digital camera or the like and forming an image on the recording paper sheet P.

The carrier 2 detachably holds the ink cartridges 2*a*. The ink cartridge 2*a* has an ink tank or a plurality of ink tanks (not shown) each for storing a predetermined color ink therein and a recording head for discharging the ink stored in the ink tank to form an image on the recording paper sheet. In this embodiment, two ink cartridges 2*a*, one of which stores black ink and the other stores, for example, yellow, cyan and magenta colored inks, respectively, are attached to the carrier 2. However, configurations of the ink cartridges are not limited to this example. A photo coupler (not shown) is further mounted on the carrier 2. The photo coupler scans over the encoder scale 7 having a predetermined resolution, thereby detecting the position of the carrier 2 in the main-scanning direction.

The driving mechanism 6 has an endless belt 6*a* disposed along the shaft 4 in the main-scanning direction and a DC motor 6*b* for driving the belt 6*a*. A part of the belt 6*a* is connected to the rear portion of the carrier 2. The driving mechanism 6 moves the carrier 2 reciprocally in the main-scanning direction with driving the belt 6*a* by the DC motor 6*b*. However, configuration of the driving mechanism 6 is not limited to this configuration.

Subsequently, an image forming operation of the ink jet printer 1 will be described. This operation is controlled by the control circuit 8. First, the recording paper sheet P placed on the paper feeding tray 11 is conveyed through the recording paper conveying mechanism 5 in the sub-scanning direction. When a front end of the recording paper sheet P is conveyed below the recording heads, the driving mechanism 6 starts to reciprocate the carrier 2 in the main-scanning direction. While the carrier 2 is reciprocated in the main-scanning direction, the recording heads discharge the ink drops toward the recording paper sheet P, a row of image is formed on the recording paper sheet P in the main-scanning direction. While the recording paper sheet P is conveyed by the recording paper conveying mechanism 5 in the sub-scanning direction, the carrier 2 is reciprocated in the main-scanning direction with discharging the ink drops so that an image is formed on the recording paper sheet P. When a complete image is formed on the recording paper sheet P by repeating the above-mentioned operation, the recording paper sheet P is ejected on the paper exit tray 12 and the image forming operation is finished.

Since the carrier 2 has a configuration of detachably holding the ink cartridges 2*a* as mentioned above, positional relationship between the ink cartridges 2*a* attached by the user and the carrier 2 may vary subtly each time of attachment. When the positional relationship between the ink cartridges 2*a* and the carrier 2 varies, the position of the recording head relative to the recording paper sheet P also varies, and thereby printing shear may occur. In order to correct the printing shear, the printing shear detection sensor 3 is provided at the side face of the carrier 2, and the control circuit 8 of the ink jet printer 1 comprises a printing shear correction control function which detects the printing shear according to need such as after replacement of the ink cartridges 2*a*, and automatically correcting the printing shear.

Figure 2:
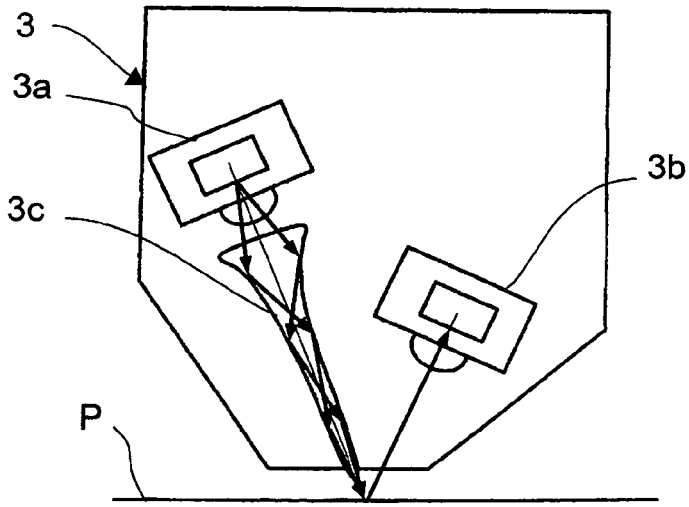
FIG. 2 is a view showing a printing shear detection sensor in the printer when viewed in a sub-scanning direction.
Figure 3:
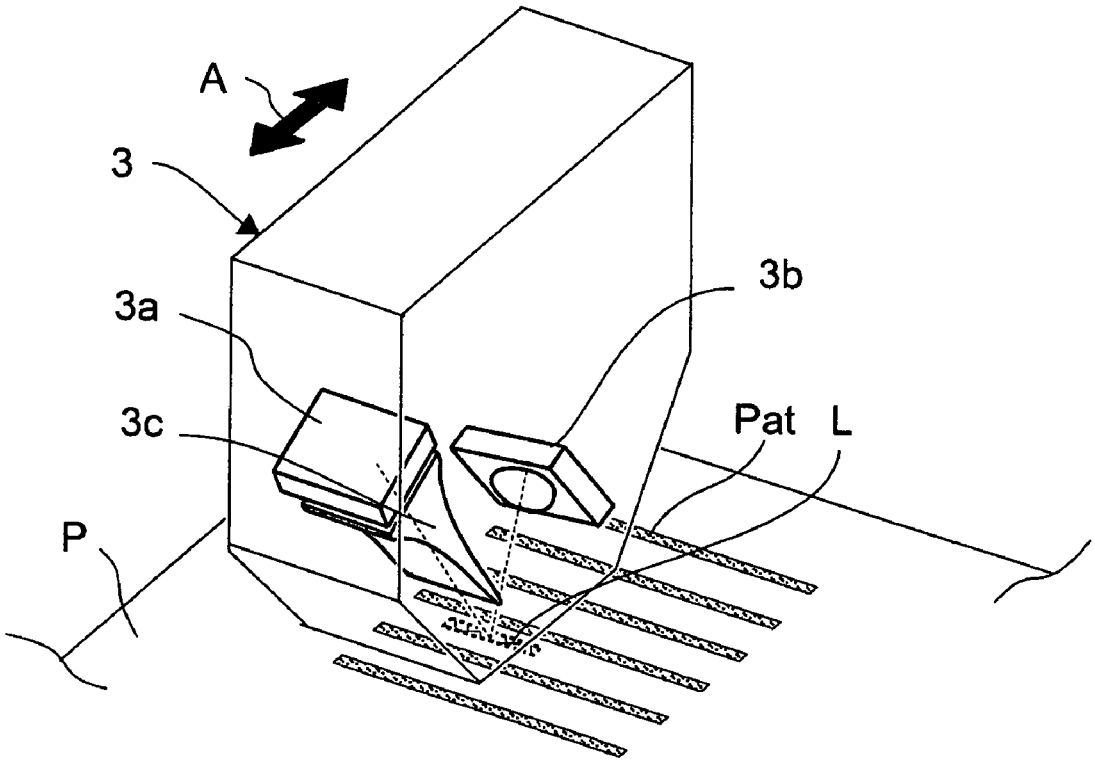
FIG. 3 is a perspective view for describing an operation of the printing shear detection sensor in the printer.

Detailed constitution of the printing shear detection sensor 3 is shown FIG. 2 and FIG. 3. The printing shear detection sensor 3 has a light emitting device 3*a* such as an LED (Light Emitting Diode), a light receiving device 3*b* such as a photo transistor for generating a signal according to intensity of received light, and a light guide 3*c* as a molded member of a transparent resin such as an acrylic resin. Arrows illustrated in FIG. 2 represent optical paths of light emitted from the light emitting device 3*a*. As shown in the figure, the light emitting device 3*a* is disposed so that the light emitted from the light emitting device 3*a* may irradiate the recording paper sheet P placed below the printing shear detection sensor 3 in a direction inclined toward the main-scanning direction with respect to the vertical direction to the recording paper sheet P. The light receiving device 3*b* is oriented so as to receive the light emitted from the light emitting device 3*a* and reflected on the recording paper sheet P. The light guide 3*c* is disposed on the optical path of the light emitted from light emitting device 3*a*. In this embodiment, since a width of the light beam emitted from the light emitting device 3*a* is gradually narrowed down while the light beams moves in the light guide 3*c* so as to have a high directivity, a condensing lens is not essential on the side of the light receiving device 3*b*. Thus, the condensing lens is omitted in the figures. The printing shear detection sensor 3 has a housing shaped to cover the light receiving device 3*b* so that outside light rarely reaches to the light receiving device 3*b*. Thus, the light incident on the light receiving device 3*b* mainly becomes the light emitted from the light emitting device 3*a* and reflected on the recording paper sheet P. However, the shape of the printing shear detection sensor 3 is not limited to this.

The light guide 3*c* has a cross section with the substantially uniform width in the sub-scanning direction and has a cross section shaped so that the width in the main-scanning direction may be gradually smaller with an increasing degree of change from the top toward the bottom, as shown in FIG. 2. In other words, the light guide 3*c* has a shape that can be formed with an inexpensive molding die distinct from the conventional condenser lens which is optically precise, so that the cost of the light guide 3*c* is lower than that of the condenser lens. Although the size of the light guide 3*c* in the sub-scanning direction is set so that the light emitted from the light emitting device 3*a* may be mostly incident on an upper surface of the light guide, the size is not limited to this. The upper surface of the light guide 3*c* is not limited to a substantially flat plane and may be protruded upwards.

As shown in FIG. 2, the light emitted from the light emitting device 3*a* is incident on the light guide 3*c* from above, passes through the light guide 3*c* while being reflected on the side surface of the light guide 3*c* and is emitted toward the recording paper sheet P from the bottom of the light guide 3*c*. At this time, the light emitted from the light guide 3*c* is guided through the portion where the width in the side cross section thereof is gradually decreased, so that the light emitted from the light guide 3*c* has a high directivity. Furthermore, as shown in FIG. 3, since the lower portion of the light guide 3*c* is shaped slender to have a smaller width, the light emitted from the light guide 3*c* is projected on the recording paper sheet P as a slit-like detection light L.

Hereinafter, a detection operation of printing shear by the printing shear detection sensor 3 and a correction operation by the controller 8 having the printing shear correction control function will be described. First, a predetermined printing shear detection pattern $P_{at}$ is formed on the recording paper sheet P by discharging ink drops from the recording head while moving the carrier 2 in the main-scanning direction. In this embodiment, the printing shear detection pattern $P_{at}$, as shown in FIG. 3, is formed of a plurality of lines. Subsequently, the carrier 2 is moved in the main-scanning direction indicated by arrow A in the figure, in a state where the light emitted from the light emitting device 3*a* is radiated on the recording paper sheet P through the light guide 3*c* as the detection light L. When the carrier 2 is moved, the slit-like detection light L scans over the printing shear detection pattern $P_{at}$, so that the intensity of the light incident on the light receiving device 3*b* varies in magnitude. The light receiving device 3*b* generates a signal according to the intensity of the light, thereby reading the printing shear detection pattern $P_{at}$. The correction operation of printing shear is carried out by controlling a timing for starting the discharge of the ink drops from the recording head provided on the ink cartridge 2*a* by the printing shear correction control function of the control circuit 8 on the basis of the printing shear detection pattern $P_{at}$ read by the printing shear detection sensor 3.

In this embodiment, since the light from the light emitting device 3*a* is radiated on the recording paper sheet P as the slit-like detection light L with using the light guide 3*c*, the printing shear detection pattern $P_{at}$ can be detected with high accuracy, similar to the conventional case of converging the light as a spot light. The light guide 3*c*, as described above, can be shaped with using the inexpensive molding die and obtained at low cost. Thus, the manufacturing costs of the ink jet printer 1 can be reduced.

The present invention is not limited to the above-mentioned configuration in this embodiment and may be variously modified. For example, the light guide is not necessarily shaped as mentioned above and needs only to have a nearly uniform width in the sub-scanning direction and have light condensing performance in the main-scanning direction.

Figure 4:
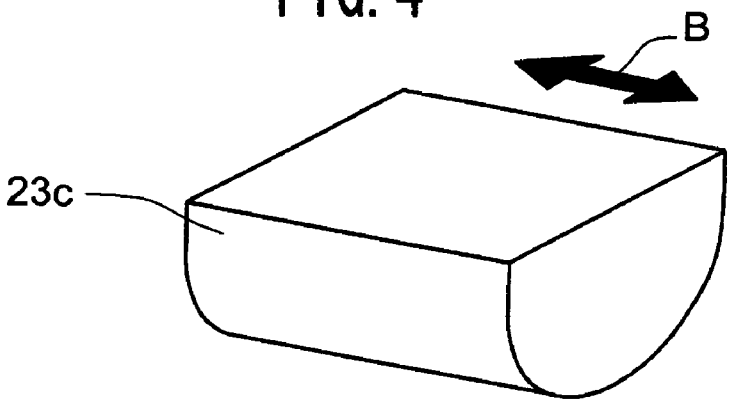
FIG. 4 is a perspective view showing a light guide in accordance with a modified example of the present invention.
Figure 5:
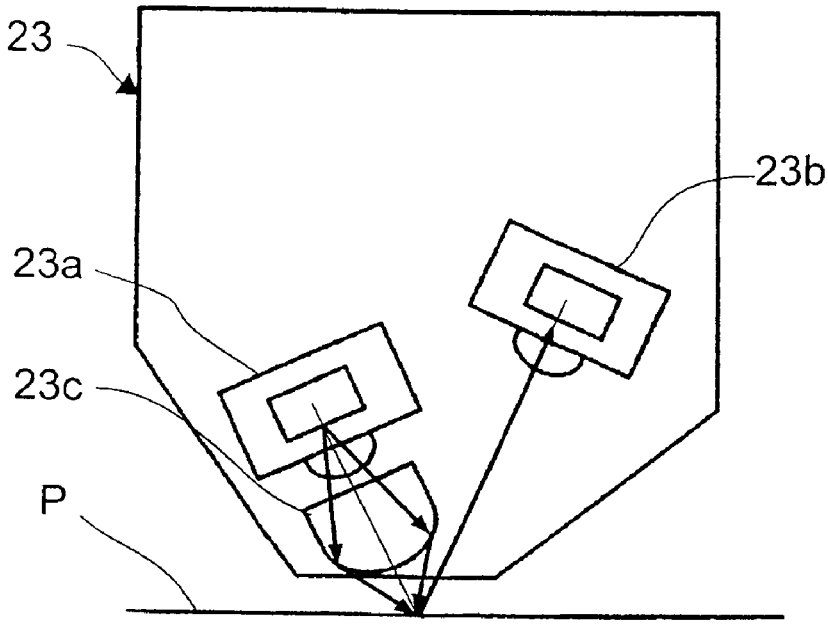
FIG. 5 is a view showing the above printing shear detection sensor having the light guide when viewed in the vertical direction.
Figure 6:
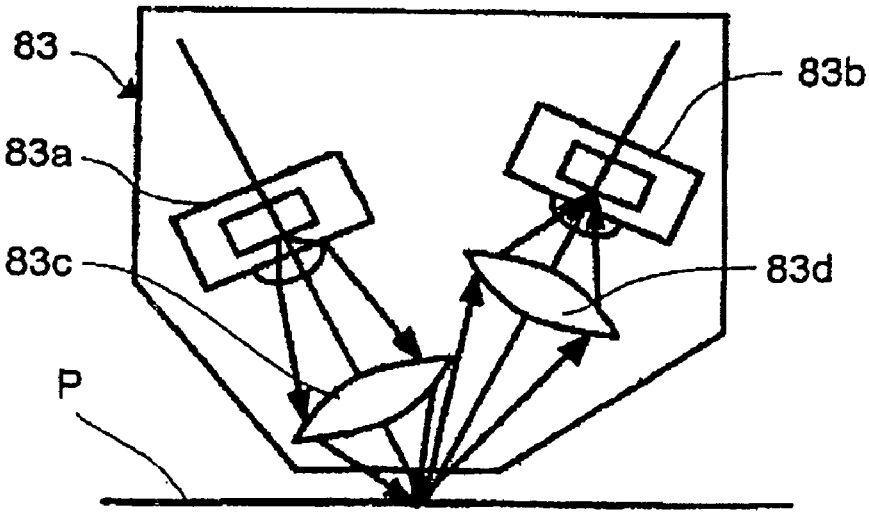
FIG. 6 (PRIOR ART)
FIG. 6 is a front view showing a printing shear detection sensor in a conventional ink jet printer.

FIG. 4 shows a configuration of a modified example of the light guide. FIG. 5 shows a configuration of the printing shear detection sensor using the light guide shown in FIG. 4. As shown in FIG. 4, the light guide 23*c* is a so-called cylindrical lens having a substantially semi-circular and uniform cross section in the sub-scanning direction indicated by arrow B. In other words, the light guide 23*c* can be also formed with using an inexpensive molding die at low manufacturing costs, similar to the above mentioned light guide 3*c*. As shown in FIG. 5, the light guide 23*c* is provided on the optical paths of the light emitted from the light emitting device 23*a* of the printing shear detection sensor 23, as indicated by arrows. As indicated by the arrows in FIG. 5, the light emitted from the light emitting device 23*a* is incident on the light guide 23*c* from above and radiated toward the recording paper sheet P from the bottom of the light guide 23*c*. At this time, the light emitted from the light emitting device 23*a* is refracted by the light guide 23*c*, condensed in the main-scanning direction and projected on the recording paper sheet P in the sub-scanning direction in the shape of a long slit. The light reflected on the recording paper sheet P is incident on the light receiving device 23*b*.

As described above, in the case where the light guide 23*c* is the cylindrical lens, the light emitted from the light emitting device 23*a* is converged and radiated on the recording paper sheet P in the shape of a slit, so that the printing shear detection pattern $P_{at}$ can be detected with high accuracy, similar to the conventional case of converging the light as a spot light.

Furthermore, since the light guide 23*c* is inexpensive, manufacturing costs of the ink jet printer 1 can be reduced.

Components constituting the printing shear detection sensor 3 are not limited to the light emitting device 3*a*, the light receiving device 3*b* and the light guide 3*c*, and the other components may be added or these components may be omitted as necessary. For example, the printing shear detection sensor 3 may be provided with a second light guide for receiving light reflected on the recording paper sheet P, converging the incident light and emitting the converged light to the light receiving device 3*b*. The area where the printing shear detection sensor 3 is formed is not limited to the side surface of the carrier 2 as described above and needs only to be formed so that the printing shear detection sensor 3 may scan over the recording paper sheet P with reciprocating movement of the carrier 2.

This application is based on Japanese patent application 2005-237246 filed Aug. 18, 2005 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An ink jet printer comprising:

an ink cartridge including an ink tank for storing ink therein and a recording head for discharging the ink stored in the ink tank to form an image on a recording paper sheet;

a cartridge holding member for holding the ink cartridge;

a driving means for reciprocating the cartridge holding member in a direction substantially perpendicular to a conveying direction of the recording paper sheet;

a printing shear detection sensor including a light emitting device which emits light toward the recording paper sheet and a light receiving device which receives the light emitted from the light emitting device and reflected on the recording paper sheet, for reading a predetermined printing shear detection pattern formed on the recording paper sheet by the recording head; and a printing shear correction control means for correcting printing shear by adjusting discharge timing of the recording head based on the printing shear detection pattern read by the printing shear detection sensor, wherein the printing shear detection sensor further has a light guide, which is a single element and other than a condensing lens, disposed on an optical path of the light emitted from the light emitting device and has a cross section with substantially uniform width in the conveying direction of the recording paper sheet, and has a cross section so as to condense the light emitted from the light emitting device on the recording paper sheet in the direction substantially perpendicular to the conveying direction of the recording paper sheet; and thereby the light emitted from the light emitting device is incident on the light guide from above, emitted toward the recording paper sheet from the bottom of the light guide and projected on the recording paper sheet substantially in a shape of a slit.

2. The ink jet printer in accordance with claim 1, wherein the light guide is shaped so that width of a side cross section when viewed in the conveying direction of the recording paper sheet is gradually decreased toward a bottom from a top thereof.

3. The ink jet printer in accordance with claim 2, wherein the width of the light guide in the conveying direction of the recording paper sheet is gradually smaller with an increasing degree of change from the top toward the bottom.

4. The ink jet printer in accordance with claim 1 wherein the light guide is a molded member of a transparent resin formed using a molding die.

5. The ink jet printer in accordance with claim 4, wherein a size of the light guide in the conveying direction of the recording paper sheet is set so that the light emitted from the light emitting device is mostly incident on an upper surface of the light guide, and the upper surface of the light guide is a substantially flat plane or protruded upwards.

* * * * *